US008650900B2

(12) United States Patent
Jeong et al.

(10) Patent No.: US 8,650,900 B2
(45) Date of Patent: Feb. 18, 2014

(54) ICE DISPENSING TECHNOLOGY

(75) Inventors: Kyung-Han Jeong, Seoul (KR); Wook-Yong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1113 days.

(21) Appl. No.: 12/328,937

(22) Filed: Dec. 5, 2008

(65) Prior Publication Data

US 2009/0145157 A1 Jun. 11, 2009

(30) Foreign Application Priority Data

Dec. 7, 2007 (KR) ..... 10-2007-0127190

(51) Int. Cl.
*F25C 5/18* (2006.01)

(52) U.S. Cl.
USPC ..... 62/344; 62/377

(58) Field of Classification Search
USPC ..... 62/344, 320, 377, 137
See application file for complete search history.

(56) References Cited

U.S. PATENT DOCUMENTS

| | | | | |
|---|---|---|---|---|
| 5,947,342 | A * | 9/1999 | Song | 222/413 |
| 6,082,130 | A | 7/2000 | Pastryk et al. | |
| 7,040,111 | B2 * | 5/2006 | Lee et al. | 62/344 |
| 7,185,507 | B2 * | 3/2007 | Maglinger et al. | 62/344 |
| 7,421,834 | B1 * | 9/2008 | Doolan | 53/570 |
| 7,770,408 | B2 * | 8/2010 | Kim et al. | 62/344 |
| 7,942,016 | B2 * | 5/2011 | Johnson et al. | 62/340 |
| 2005/0044874 | A1 * | 3/2005 | Lee et al. | 62/344 |
| 2006/0065008 | A1 * | 3/2006 | Park | 62/344 |
| 2006/0202071 | A1 * | 9/2006 | Jung et al. | 241/34 |
| 2007/0084230 | A1 | 4/2007 | Krause et al. | |
| 2008/0156023 | A1 * | 7/2008 | Kim et al. | 62/344 |
| 2008/0295536 | A1 * | 12/2008 | Kim et al. | 62/340 |
| 2008/0295538 | A1 * | 12/2008 | Kim et al. | 62/354 |
| 2010/0281908 | A1 * | 11/2010 | Kim | 62/344 |

FOREIGN PATENT DOCUMENTS

| | | |
|---|---|---|
| KR | 10-0565617 | 3/2006 |
| KR | 10-0577184 | 5/2006 |

OTHER PUBLICATIONS

International Search Report & Written Opinion issued in International Application No. PCT/KR2008/007179, mailed Jun. 22, 2009, 11 pages.

* cited by examiner

*Primary Examiner* — Mohammad M Ali
(74) *Attorney, Agent, or Firm* — Fish & Richardson P.C.

(57) ABSTRACT

Disclosed are an ice bin installed in a refrigerator or the like and a refrigerating machine having the same. One auger having spiral transfer wings rotates to transfer ice cubes that are introduced between the transfer wings, which allows a constant amount of ice or an amount of ice selected by a user to be dispensed. In addition, a shutter is disposed at a lower side of the auger to define a dispensing space, which may reduce a length of a casing in a depth direction and, thereby, result in a reduced size of the ice bin.

22 Claims, 7 Drawing Sheets

ICE DISPENSING TECHNOLOGY

CROSS REFERENCE TO RELATED APPLICATIONS

The present application claims the benefit of priority to Korean Application No. 10-2007-0127190, filed on Dec. 7, 2007, which is herein expressly incorporated by reference in its entirety.

FIELD

The present disclosure relates to ice dispensing technology.

BACKGROUND

In general, an icemaker is a device that makes ice, and that is installed in a refrigerator or a water purifier. Many attempts have recently been made to diversify and improve the quality of offered refrigerating machines, such as refrigerators or water purifiers.

Refrigerating machines that include ice-making devices may be further provided with an ice bin capable of storing ice cubes (e.g., pieces of ice, ice, etc.) made by an icemaker. The ice bin may be configured to, when a user selects an ice ejection operation, eject a certain amount of ice among many pieces of ice stored in an ice bin.

In refrigerating machines having the aforementioned ice bins, the pieces of ice stored in the ice bin may be stuck together, making it difficult to discharge ice pieces smoothly or preventing smooth discharge altogether. Moreover, when ice pieces are ejected, pieces of ice may be broken, thereby varying an amount of ice being dispensed and potentially allowing for an excessive amount of ice to be dispensed at one time.

SUMMARY

In one aspect, an ice bin includes a casing that includes an ice storage and an outlet through which ice cubes stored in the ice storage are dispensed, and a motor assembly configured to generate a rotational force. The ice bin also includes an auger that is positioned in a cavity defined by the casing, that is configured to rotate about a rotational axis in response to the rotational force generated by the motor assembly, and that has spiral transfer wings that protrude from the rotational axis of the auger and that are configured to impart force against an ice cube in the ice storage based on rotation of the auger about the rotational axis to promote movement of the ice cube toward the outlet of the casing. The ice bin further includes a shutter configured to move between a closed position at which the shutter closes the outlet and prevents passage of an ice cube through the outlet and an opened position at which the shutter opens the outlet and enables passage of an ice cube through the outlet. The shutter is configured to move from the closed position to the opened position in response to force imparted against the shutter by an ice cube whose movement toward the outlet is being promoted based on rotation of the auger about the rotational axis and is configured to move from the opened position to the closed position in response to a reduction in force imparted against the shutter by an ice cube whose movement toward the outlet is being promoted based on rotation of the auger about the rotational axis.

Implementations may include one or more of the following features. For example, the shutter may include a flexible material that has a self-restoring force that moves the shutter from the opened position to the closed position in response to release of force imparted against the shutter by an ice cube whose movement toward the outlet is being promoted based on rotation of the auger about the rotational axis. One end of the shutter may be fixedly coupled to the casing, and an opposite end of the shutter may be a free end that is not fixed to the casing.

In some examples, the shutter may be elastically supported by an elastic member having a restoring force that moves the shutter from the opened position to the closed position in response to release of force imparted against the shutter by an ice cube being transferred toward the outlet by the spiral transfer wings. The shutter may be coupled to the casing by a hinge.

In some implementations, the ice bin may include a guide that is positioned between the ice storage and the auger and that is configured to, when the ice bin is in an ordinary operating orientation, guide ice cubes toward the shutter based on gravitational force. The guide may define a through hole that allows ice cubes to pass through the guide when the shutter is in the opened position.

The auger may include a shaft portion coupled to a rotational shaft of the motor, and the spiral transfer wings may extend from an outer circumferential surface of the shaft portion and may be separated by a distance and shaped to define a space that is sized to accommodate an ice cube guided by the auger. The auger may include a disk-shaped reinforcing portion connected to side ends of adjacent transfer wings and the shaft portion. The auger also may have one or more joint portions that are defined at an inner circumferential surface of the shaft portion to be engaged with the rotational shaft and that are configured to transfer a rotational force of the motor to the auger.

In some examples, the rotational shaft of the motor may have at least one driving force transferring portion that extends wider than a diameter of the rotational shaft of the motor and that is configured to couple to at least one of the one or more joint portions. The driving force transferring portion may have a protrusion defined at an outer circumferential surface and the joint portion has a groove defined at inner circumferential surface that corresponds to the outer circumferential surface of the driving force transferring portion. The protrusion and groove may be engaged with each other to restrict the auger in a direction of rotation of the rotational shaft.

The rotational shaft and the auger respectively may have D-shaped surfaces corresponding to each other. Each of the transfer wings of the auger may have a curved or inclined cross section in the direction of rotation of the auger. In addition, each of the transfer wings of the auger may include a first wing portion and second wing portions that are integrally positioned with each other. The first wing portion may extend in a radial direction from the shaft portion to a central portion thereof, and the second wing portion may be curved or inclined in the direction of rotation of the auger. The auger may be configured to dispense a constant number of ice cubes when the auger is rotated through an angle that corresponds to a space defined between adjacent transfer wings.

In another aspect, a refrigerating machine includes a refrigerating machine case, an icemaker positioned in the refrigerating machine case and configured to make ice, and an ice bin configured to store ice made by the icemaker. The refrigerating machine also includes an auger that is positioned in a cavity defined by the ice bin, that is configured to rotate about a rotational axis, and that has spiral transfer wings based on rotation of the auger about the rotational axis to promote movement of the ice cube. The refrigerating machine further includes a shutter that is positioned at the ice bin and that is configured to, in response to force imparted against the shutter by an ice cube whose movement is being promoted by the spiral transfer wings, move from a closed position at which the shutter prevents the ice cube from being transferred out of the ice bin to an opened position to allow the ice cube to be transferred out of the ice bin and dispensed. The refrigerating machine includes a selector configured to enable a user to select a desired amount of ice and a controller that is electrically connected to the selector and that is configured to control rotation of the auger to dispense the desired amount of ice selected by the user.

Implementations may include one or more of the following features. For example, the shutter may include a flexible material that has a self-restoring force that moves the shutter from the opened position to the closed position in response to reduction of force imparted against the shutter by an ice cube whose movement is being promoted based on rotation of the auger about the rotational axis. One end of the shutter may be fixedly coupled to a casing of the ice bin, and an opposite end of the shutter may be a free end that is not fixed to the casing.

In some examples, the shutter may be coupled to a casing of the ice bin by a hinge and elastically supported by an elastic member having a restoring force that moves the shutter from the opened position to the closed position in response to reduction of force imparted against the shutter by an ice cube whose movement is being promoted based on rotation of the auger about the rotational axis. The auger may include a shaft portion coupled to a rotational shaft of a motor assembly. The spiral transfer wings may extend from an outer circumferential surface of the shaft portion and may be separated by a distance and shaped to define a space that is sized to accommodate an ice cube guided by the auger. The controller may be configured to control rotation of the auger to dispense the desired amount of ice selected by the user by controlling the auger to rotate a particular rotation angle.

In yet another aspect, a method of controlling dispensing of ice includes receiving, from a user, user input indicating a selection of a desired amount of ice and receiving, from the user, user input indicating a command to dispense the desired amount of ice. Based on the user input, an amount of rotation of an auger needed to dispense the desired amount of ice is determined. The auger is configured to rotate about a rotational axis and has spiral transfer wings that protrude from the rotational axis of the auger and that are configured to impart force against an ice cube to promote movement of the ice cube from an ice bin. The method also includes controlling the auger to rotate the determined amount of rotation to dispense the desired amount of ice.

Implementations may include one or more of the following features. For example, the method may include receiving, from the user, user input indicating a number of ice cubes. The method also may include receiving, from the user, user input indicating a range of a number of ice cubes. The method further may include determining an angle of rotation of the auger needed to dispense the desired amount of ice.

DETAILED DESCRIPTION

Figure 1:
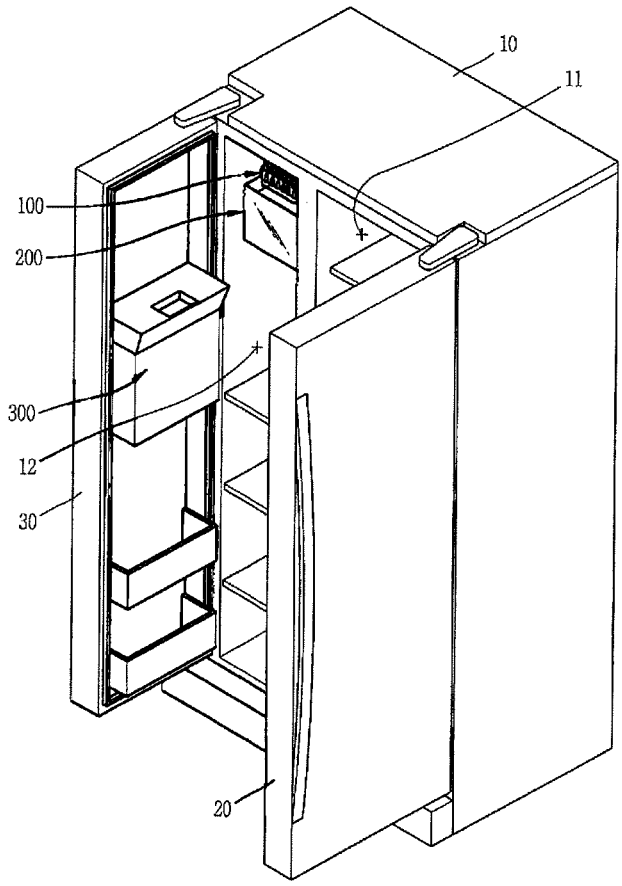
FIG. 1 is a perspective view showing a refrigerator.

As shown in FIG. 1, a refrigerator having an ice bin may include a refrigerator main body 10, and a refrigerating chamber door 20 that may be opened and closed to expose or restrict access to a refrigerating chamber 11 and a freezing chamber door 30 that may be opened and closed to expose or restrict access to a freezing chamber 12 of the refrigerator main body 10. As shown, the refrigerator is oriented in an ordinary operating orientation.

The refrigerator may further include an icemaker 100 installed inside the freezing chamber 12 for making pieces of ice, an ice dispensing apparatus (hereinafter, referred to as 'ice bin') 200 installed below the icemaker 100 for storing pieces of ice made by the icemaker 100, and an ice dispenser 300 installed at an outside of the freezing chamber door 30 for supplying ice stored in the ice bin 200 according to a user's input.

Figure 2:
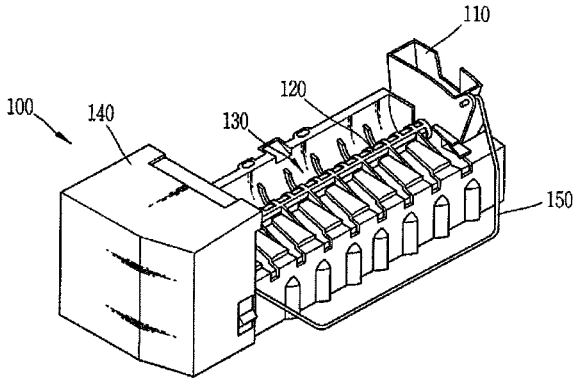
FIG. 2 is a perspective view showing an icemaker mounted in a refrigerator.

As shown in FIG. 2, the icemaker 100 may include a water supplying unit 110 through which water is supplied from a source exterior to the refrigerator, an ice making chamber 120 for making ice using the water supplied via the water supplying unit 110, an ejector 130 for separating ice made in the ice making chamber 120, and a control box 140 having components for controlling the rotation of the ejector 130. A mounting portion (not shown) in which the icemaker 100 is mounted in the refrigerator is positioned at a rear side of the ice making chamber 120. An ice level detecting lever 150 is disposed at a front side of the ice making chamber 120 and is configured to check whether or not to operate the icemaker 100 based on whether the ice bin 200 full of ice.

Figure 3:
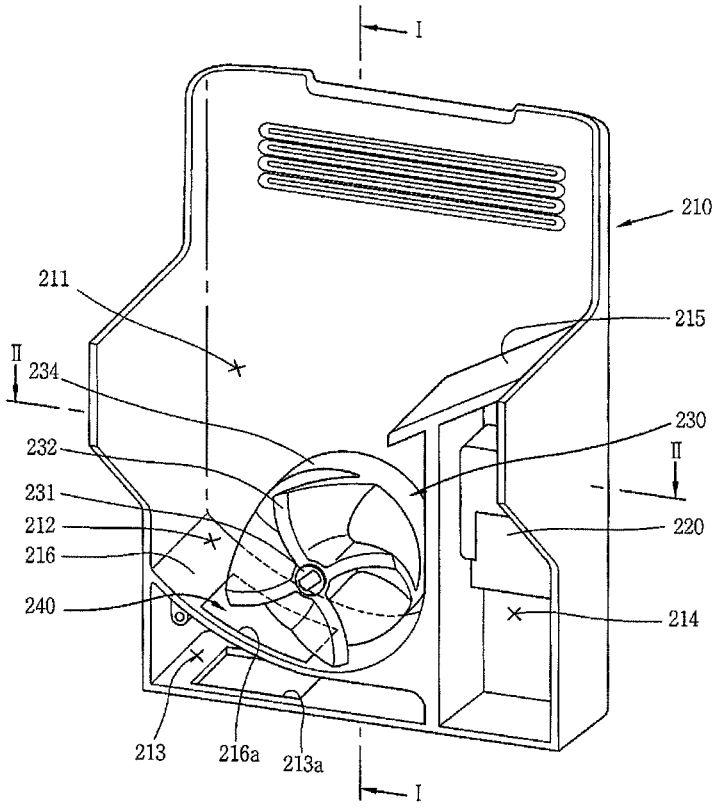
FIG. 3 is a perspective view showing an ice bin applied to a refrigerator.
Figure 4:
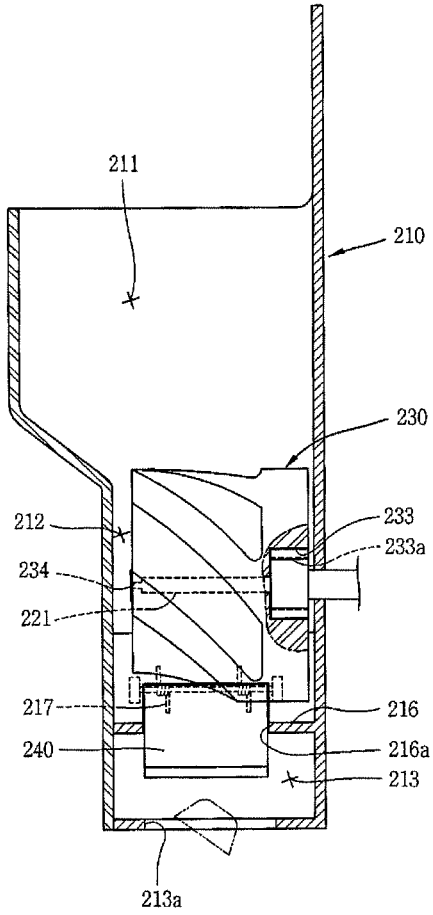
FIG. 4 is a cross-sectional view taken along the line "I-I" of FIG. 3.
Figure 5:
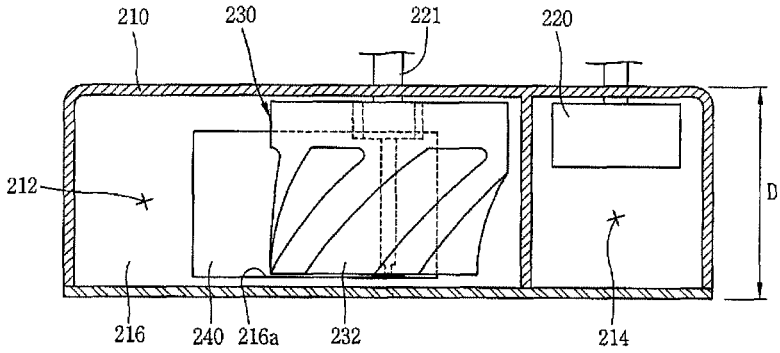
FIG. 5 is a cross-sectional view taken along the line "II-II" of FIG. 3.

As shown in FIGS. 3 to 5, the ice bin 200 may include a casing 210 having a certain inner space, a motor 220 installed at one side of the casing 210 to generate a rotational force, an auger 230 that is coupled to a rotational shaft of the motor 220 and that is configured to transfer ice piece by piece, and a shutter 240 that is installed below the auger 230, that is configured to rotate with respect to the casing 210, and that is configured to transfer ice by being pressed with ice placed thereon upon the rotation of the auger 230.

As shown in FIGS. 3 to 5, an ice storage 211 for storing ice transferred from the icemaker 100 is positioned at an upper side of the casing 210, and a transfer space 212 in which the auger 230 is installed is positioned at a lower side of the ice storage 211. Also, a dispensing space 213 having an outlet 213*a* through which ice is dispensed is positioned at a lower side of the transfer space 212 and divided by the shutter 240. A motor room 214 in which a motor 220 is installed is positioned at one side of the transfer space 212. The motor 220 is installed in the motor room 214 and coupled to a deceleration gear (not shown) disposed at a rear side of the casing 210. A driven rotational shaft 221 of the deceleration gear extends inwardly to the transfer space 212 of the casing 210 and coupled to the auger 230.

Figure 7:
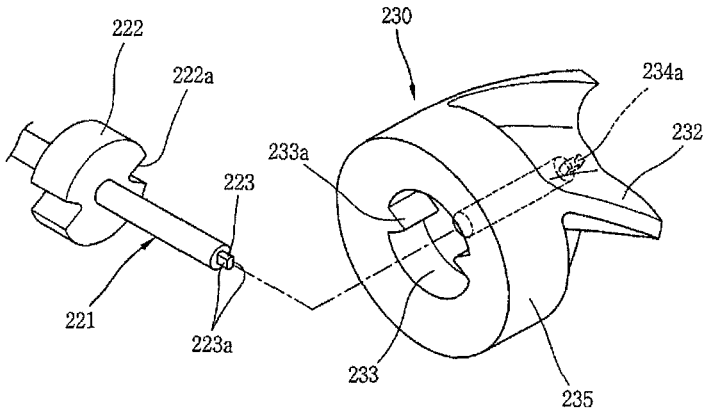
FIG. 7 is a perspective view showing a rear surface of an auger of the ice bin shown in FIG. 3.

The driven rotational shaft 221, as shown in FIG. 7, has a first driving force transferring portion 222 and a second driving force transferring portion 223. Although not shown in the drawing, in several examples, only the first driving force transferring portion 222 may be included. The first driving force transferring portion 222 has a diameter which is greater than an average diameter of the driven rotational shaft 221 so as to transfer a relatively great driving force, and the second driving force transferring portion 223 has a diameter smaller than the average diameter of the driven rotational shaft 221 so as to allow the first driving force transferring portion 222 to transfer a driving force in balance along a shaft portion 231 of the auger 230. At least one driving groove 222*a* which is engaged with a driving protrusion 233*a* to be explained in more detail later is positioned in a radial direction at an outer circumferential surface of the first driving force transferring portion 222 so as to restrict the driving protrusion 233*a* in a rotating direction of a shaft, for example, in a circumferential direction. The second driving force transferring portion 223 has first driven surfaces 223*a* defined in parallel to each other in a D-cut shape and engaged with second driven surfaces 234*a* to be explained in more detail later to restrict the second driven surfaces 234*a* in a circumferential surface. In some examples, the driving groove 222*a* and the driving protrusion 233*a* may be positioned at opposite sides to each other.

Referring to FIG. 3, a first guide 215 for guiding ice from the ice storage 211 toward the shutter 240 is positioned between the ice storage 211 and the transfer space 212, for example, at an upper side of the motor room 214. The first guide 215 is inclined downwardly from an upper wall surface facing the side having the shutter 240 of the casing 210 toward a central portion.

A second guide 216 is positioned at a lower wall surface of the transfer space 212 such that the second guide 216 allows the shutter 240 to rotate. An upper surface of the second guide 216 may be downwardly inclined or curved to enable a smooth sliding of ice. A through hole 216*a* is provided through the second guide 216. The through hole 216*a* is open/closed by the shutter 240 to transfer ice in the ice storage 211 to the dispensing space 213 piece by piece (e.g., one piece at a time).

Figure 6:
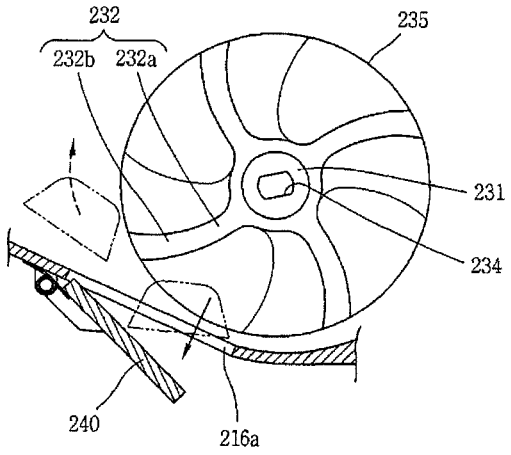
FIG. 6 is a schematic view showing a process of dispensing ice from the ice bin shown in FIG. 3.

As shown in FIGS. 6 and 7, the auger 230 may include a shaft portion 231 coupled to the driven rotational shaft 221 extending from the rear side of the casing 210, and a plurality of transfer wings 232 radially protruded from an outer circumferential surface of the shaft portion 231. The transfer wings 232 may have a certain interval therebetween along a circumferential direction that is defined to enable the transfer wings 232 to guide ice.

The shaft portion 231 is penetrated in a shaft direction. A first joint portion 233 engaged with the first driving force transferring portion 222 of the driven rotational shaft 221 is positioned at an inner circumferential surface of one side of the shaft portion 231. A second joint portion 234 engaged with the second driving force transferring portion 223 of the driven rotational shaft 221 is positioned at the inner circumferential surface of another side of the shaft portion 231. At least one or more driving protrusions 233*a* are protruded from the inner circumferential surface of the first joint portion 233. The at least one or more driving protrusions 233*a* are engaged with the driving groove 222*a* to be restricted in the rotating direction of the shaft, for example, in the circumferential direction. The driving protrusion 233*a* is shown in a wedge shape in the drawings; however, it may be configured in various shapes such as a semicircular or polygonal shape.

The second joint portion 234 has second driven surfaces 234*a* corresponding to the first driven surfaces 223*a* defined at the second driving force transferring portion 223 of the driven rotational shaft 221. The second driven surfaces 234*a* may be configured such that both surfaces are D-cut in parallel to each other or any one surface is D-cut, or configured in other shapes to be restricted in a circumferential direction.

The transfer wings 232 may be defined to be curved or spirally inclined in a rotating direction. For example, the transfer wings 232, as shown in FIG. 6, are configured such that first wing portions 232*a* are radially formed by a certain length at an outer circumferential surface of the shaft portion 231, and second wing portions 232*b* extend from ends of each first wing portion 232*a* to be curved or inclined in a rotating direction. A side surface of the second wing portion 232*b* of each transfer wing 232, as shown in FIG. 6, serves to push an ice piece or cube located at an outside thereof toward an opposite side of the shutter 240. Each transfer wing 232 is configured to prevent a large amount of ice from being ejected at once (e.g., the transfer wings 232 may be shaped/configured to transfer one ice cube at a time). Side ends of the transfer wings 232 are connected to each other by a reinforcing portion 235 in a shape of a disc to be supported.

The auger 230 may be defined to receive one or two ice cubes between the transfer wings 232. The auger 230 may be made of a flexible material so as to prevent ice from being broken during storing or transferring. However, since the auger 230 pushed the ice pieces, it may be disadvantageous for the auger 230 to be made of too soft of a material.

The auger 230 may dispense one or two ice pieces or cubes when rotated based on the interval between the neighboring transfer wings 232. For example, in an example in which four transfer wings 232 are separated by an interval of about 90°, whenever the auger 230 rotates by 90°, namely, by one fourth, one or two ice cubes are dispensed. In this example, when a use selects the number of ice cubes using a selector disposed at the ice dispenser 300, a controller (not shown) having received the selection signal determines the rotational angle of the motor 220 which operates the auger 230 to allow the dispensing of the selected number of ice cubes. If the user selects 3 to 6 ice cubes when the transfer wings 232 are defined by the 90° interval, then the controller controls the auger 230 to rotate by 270° and thereby dispense 3 to 6 ice cubes in sequence.

Figure 8:
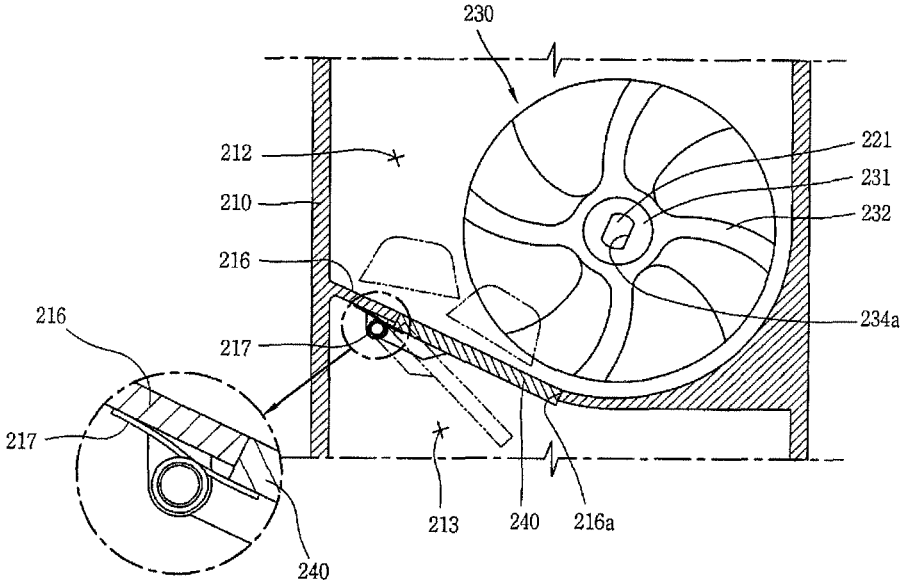
FIGS. 8 and 9 are schematic views showing a shutter in an ice bin.
Figure 9:
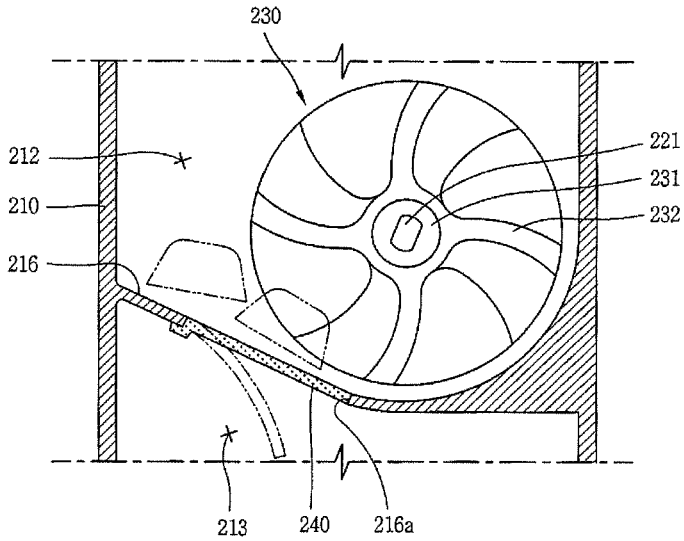

As shown in FIG. 8, one end of the shutter 240 may be hinge-coupled to the second guide 216 or attached or press-fitted thereto. For example, the one end of the shutter 240, as shown in FIG. 8, is hinge-coupled to one side of the through hole 216*a*, and an elastic member 217 such as a step spring or tension spring may be coupled to the one end of the shutter 240. Accordingly, when the shutter 240 rotates in a clockwise direction in the drawing based upon the hinge to be open, it rotates in a counterclockwise direction to be closed. Also, as shown in FIG. 9, the shutter 240 may be a flexible material having its own elastic force. One end of the shutter 240 is then attached or press-fitted to the through hole 216*a* of the second guide 216 or coupled thereto by a screw, and then another end of the shutter 240 may be a free end with respect to the second guide 216.

As shown in FIG. 5, the reference numeral D denotes a depth of the ice bin 200.

Operation of the ice bin is described in more detail below. First, ice cubes made in the ice making chamber 120 of the icemaker 100 are transferred to the ice storage 211 disposed at the upper side of the casing 210 of the ice bin 200 to be stored therein. The ice cubes stored in the ice storage 211 remain in the stored state until a user initiates an ice ejection operation of the ice dispenser 300. An appropriate amount of ice may be stored and maintained in the ice storage 211 by the ice level detecting lever 150 disposed in the icemaker 100.

When the user selects to eject ice from the ice dispenser 300, the motor 220 of the ice bin 200 is driven and accordingly the auger 230 rotates in a counterclockwise direction in the drawing, as shown in FIGS. 8 and 9. Accordingly, one or two ice cubes stored in the transfer space 212 of the casing 210 are introduced between two neighboring transfer wings 232 of the auger 230.

Then, the auger 230 continues to rotate with the ice cubes between the transfer wings 230. When the ice cubes introduced between the transfer wings 232 arrive at the upper side of the shutter 240, the shutter 240 is open by a force applied to the ice cubes by the transfer wing 232. Accordingly, the ice cubes are dropped on the dispensing space 213 through the through hole 216*a*, as represented by a solid arrow in FIG. 6. Such ice cubes are then supplied to the ice dispenser 300 via the outlet 213*a*. In this example, because the transfer wings 232 of the auger 230 are defined to be curved or inclined in a rotating direction of the auger 230, an ice cube placed at the outside of the transfer wing 232 is slid outwardly from the transfer wing 232, as represented by a dotted arrow in FIG. 6, whereby several ice cubes can be prevented from being dispensed at once.

After one or two ice cubes stored between the transfer wings 232 are dropped, the force having pressed the shutter is temporarily removed. Hence, the shutter 240 is closed by the elastic member 217 or its own restoring force, thus to prevent several ice cubes from being transferred to the dispensing space 213 at once.

As mentioned above, as ice cubes made by the icemaker can be dispensed piece by piece from the auger of the ice bin, such ice can be dispensed without being broken and also many ice cubes may not be dispensed at once. In addition, the shutter is disposed below the auger so as to define a dispensing space, thus to reduce the length of the casing in its depth-wise direction, thereby reducing a size of the ice bin.

In an ice bin and a refrigerating machine having the same, one auger having spiral transfer wings rotates to transfer ice cubes that are introduced between the transfer wings, which allows a constant amount of ice or an amount of ice selected by a user to be dispensed. In addition, a shutter may be disposed below the auger to define a dispensing space, so as to reduce a length of a casing in its depth-wise direction, resulting in a reduced size of the ice bin.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An ice bin comprising:

a casing that includes an ice storage and an outlet through which ice cubes stored in the ice storage are dispensed;

a motor assembly configured to generate a rotational force;

an auger that is positioned in a cavity defined by the casing, that is configured to rotate about a rotational axis in response to the rotational force generated by the motor assembly, and that has a shaft portion coupled to a rotation shaft so as to be transferred a rotation force, a plurality of transfer wings each spirally protruding from an outer circumferential surface of the shaft portion in a circumferential direction, two adjacent of the transfer wings being separated by a distance and shaped to cooperatively define a space there between that is sufficiently sized to accommodate an ice cube from within the ice storage, the transfer wings being configured to rotate with the shaft portion and to impart force against the ice cube accommodated by the two adjacent transfer wings to transfer the ice to a through hole of the casing, and a disk-shaped reinforcing portion connected to one side end of each transfer wing;

a shutter configured to move between a closed position at which the shutter closes the through hole and prevents passage of an ice cube through the through hole and an opened position at which the shutter opens the through hole and enables passage of an ice cube through the through hole, the shutter being configured to move from the closed position to the opened position in response to force imparted against the shutter by an ice cube whose movement toward the through hole is being promoted based on rotation of the auger about the rotational axis and being configured to move from the opened position to the closed position in response to a reduction in force imparted against the shutter by an ice cube whose movement toward the through hole is being promoted based on rotation of the auger about the rotational axis, wherein a transfer space in which the auger is installed is located at a lower side of the ice storage, and a dispensing space having the outlet through which ice is dispensed is located at a lower side of the transfer space and is separated from the transfer space by the shutter; and a guide that is positioned between the dispensing space and the auger and that is configured to, when the ice bin is in an ordinary operating orientation, guide ice cubes toward the shutter based on gravitational force, wherein the guide defines the through hole that allows ice cubes to pass through the guide when the shutter is in the opened position, and the through hole is located within a dimension of the rotational axis of the auger, and wherein the auger is configured to receive one or two ice cubes between the transfer wings and the auger, including the transfer wings, is made of a flexible material that reduces a likelihood of ice cubes being broken during transfer by the auger.

2. The ice bin of claim 1, wherein the shutter includes a flexible material that has a self-restoring force that moves the shutter from the opened position to the closed position in response to release of force imparted against the shutter by an ice cube whose movement toward the through hole is being promoted based on rotation of the auger about the rotational axis.

3. The ice bin of claim 2, wherein one end of the shutter is fixedly coupled to the casing, and an opposite end of the shutter is a free end that is not fixed to the casing.

4. The ice bin of claim 1, wherein the shutter is elastically supported by an elastic member having a restoring force that moves the shutter from the opened position to the closed position in response to release of force imparted against the shutter by an ice cube being transferred toward the through hole by the spiral transfer wings.

5. The ice bin of claim 4, wherein the shutter is coupled to the casing by a hinge.

6. The ice bin of claim 1, wherein the auger has one or more joint portions that are defined at an inner circumferential surface of the shaft portion to be engaged with the rotational shaft and that are configured to transfer a rotational force of the motor to the auger.

7. The ice bin of claim 6, wherein the rotational shaft of the motor has at least one driving force transferring portion that extends wider than a diameter of the rotational shaft of the motor and that is configured to couple to at least one of the one or more joint portions.

8. The ice bin of claim 7, wherein the at least one driving force transferring portion has a protrusion defined at an outer circumferential surface and the one or more joint portion has a groove defined at inner circumferential surface that corresponds to the outer circumferential surface of the driving force transferring portion, the protrusion and groove being engaged with each other to restrict the auger in a direction of rotation of the rotational shaft.

9. The ice bin of claim 1, wherein each of the transfer wings of the auger has a curved or inclined cross section in the direction of rotation of the auger.

10. The ice bin of claim 9, wherein each of the transfer wings of the auger comprises a first wing portion and second wing portions that are integrally positioned with each other, wherein the first wing portion extends in a radial direction from the shaft portion to a central portion thereof, and the second wing portion is curved or inclined in the direction of rotation of the auger.

11. The ice bin of claim 1, wherein the auger is configured to dispense a constant number of ice cubes when the auger is rotated through an angle that corresponds to a space defined between adjacent transfer wings.

12. The ice bin of claim 1, wherein a width of the through hole is less than a length of the rotational axis of the auger, the width of the through hole and the length of the rotational axis of the auger being parallel.

13. The ice bin of claim 1, wherein the rotational axis of the auger is positioned completely over the through hole.

14. The ice bin of claim 1, wherein the rotational axis of the auger spans an entire width of the through hole.

15. A refrigerating machine comprising:

a refrigerating machine case;

an icemaker positioned in the refrigerating machine case and configured to make ice;

an ice bin configured to store ice made by the icemaker;

an auger that is positioned in a cavity defined by the ice bin, that is configured to rotate about a rotational axis, and that has spiral transfer wings based on rotation of the auger about the rotational axis to promote movement of ice cubes stored in the ice bin, a shutter that is positioned at the ice bin and that is configured to, in response to force imparted against the shutter by an ice cube whose movement is being promoted by the spiral transfer wings, move from a closed position at which the shutter prevents the ice cube from being transferred out of the ice bin to an opened position to allow the ice cube to be transferred out of the ice bin and dispensed, wherein a transfer space in which the auger is installed is located at a lower side of the ice bin, and a dispensing space having an outlet through which ice is dispensed is located at a lower side of the transfer space and is separated from the transfer space by the shutter;

a guide that is positioned between the dispensing space and the auger and that is configured to, when the ice bin is in an ordinary operating orientation, guide ice cubes toward the shutter based on gravitational force;

a selector configured to enable a user to select a desired amount of ice; and a controller that is electrically connected to the selector and that is configured to control rotation of the auger to dispense the desired amount of ice selected by the user, wherein the guide defines a through hole that allows ice cubes to pass through the guide when the shutter is in the opened position, and the through hole is located within a dimension of the rotational axis of the auger, and wherein the auger is configured to receive one or two ice cubes between the transfer wings and the auger, including the transfer wings, is made of a flexible material that reduces a likelihood of ice cubes being broken during transfer by the auger.

16. The refrigerating machine of claim 15, wherein the shutter includes a flexible material that has a self-restoring force that moves the shutter from the opened position to the closed position in response to reduction of force imparted against the shutter by an ice cube whose movement is being promoted based on rotation of the auger about the rotational axis, wherein one end of the shutter is fixedly coupled to a casing of the ice bin, and an opposite end of the shutter is a free end that is not fixed to the casing.

17. The refrigerating machine of claim 15, wherein the shutter is coupled to a casing of the ice bin by a hinge and elastically supported by an elastic member having a restoring force that moves the shutter from the opened position to the closed position in response to reduction of force imparted against the shutter by an ice cube whose movement is being promoted based on rotation of the auger about the rotational axis.

18. The refrigerating machine of claim 15, wherein the auger comprises a shaft portion coupled to a rotational shaft of a motor assembly; and the spiral transfer wings extend from an outer circumferential surface of the shaft portion and are separated by a distance and shaped to define a space that is sized to accommodate an ice cube guided by the auger.

19. The refrigerating machine of claim 15, wherein the controller is configured to control rotation of the auger to dispense the desired amount of ice selected by the user by controlling the auger to rotate a particular rotation angle.

20. The refrigerating machine of claim 15, wherein a width of the through hole is less than a length of the rotational axis of the auger, the width of the through hole and the length of the rotational axis of the auger being parallel.

21. The refrigerating machine of claim 15, wherein the rotational axis of the auger is positioned completely over the through hole.

22. The refrigerating machine of claim 15, wherein the rotational axis of the auger spans an entire width of the through hole.

* * * * *